US009528334B2

(12) United States Patent
Davis et al.

(10) Patent No.: US 9,528,334 B2
(45) **Date of Patent: *Dec. 27, 2016**

(54) WELL DRILLING METHODS WITH AUTOMATED RESPONSE TO EVENT DETECTION

(75) Inventors: Nancy Davis, Irving, TX (US); Cody Butler, Dallas, TX (US); Charles M. Pool, Bedford, TX (US); Ryan Hourd, Calgary (CA); Aaron Reynolds, Dallas, TX (US); Craig W. Godfrey, Dallas, TX (US); Frank Urias, Plano, TX (US); Saad Saeed, Houston, TX (US); Emad Bakri, Houston, TX (US); James R. Lovorn, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 792 days.

This patent is subject to a terminal disclaimer.

(21) Appl. No.: 13/491,513

(22) Filed: Jun. 7, 2012

(65) Prior Publication Data

US 2012/0241217 A1 Sep. 27, 2012

Related U.S. Application Data

(63) Continuation-in-part of application No. 12/831,716, filed on Jul. 7, 2010.

(51) Int. Cl.
*E21B 44/00* (2006.01)
*E21B 21/10* (2006.01)
(Continued)

(52) U.S. Cl.
CPC ..... *E21B 21/10* (2013.01); *E21B 44/00* (2013.01); *E21B 47/00* (2013.01); *E21B 21/08* (2013.01); *E21B 2021/006* (2013.01)

(58) Field of Classification Search
CPC ..... E21B 47/00; E21B 21/10; E21B 47/18; E21B 44/00; E21B 44/005; G01V 9/02
See application file for complete search history.

(56) References Cited

U.S. PATENT DOCUMENTS 4,188,624 A 2/1980 Hochsprung et al.
4,606,415 A 8/1986 Gray, Jr. et al.
(Continued)

FOREIGN PATENT DOCUMENTS

CN 2134484 Y 5/1993
EA 007837 B1 2/2007
(Continued)

OTHER PUBLICATIONS

International Search Report with Written Opinion issued Mar. 5, 2015 for PCT Patent Application No. PCT/US2011/042917, 9 pages.

(Continued)

*Primary Examiner* — Nicole Coy
(74) *Attorney, Agent, or Firm* — Chamberlain Hrdlicka

(57) ABSTRACT

A well drilling method can include detecting a drilling event by comparing a parameter signature generated during drilling to an event signature indicative of the drilling event, and automatically controlling a drilling operation in response to at least a partial match resulting from comparing the parameter signature to the event signature. A well drilling system can include a control system which compares a parameter signature for a drilling operation to an event signature indicative of a drilling event, and a controller which controls the drilling operation automatically in response to the drilling event being indicated by at least a partial match between the parameter signature and the event signature.

61 Claims, 5 Drawing Sheets

(51) Int. Cl.

| | |
|---|---|
| ***E21B 47/00*** | (2012.01) |
| *E21B 21/08* | (2006.01) |
| *E21B 21/00* | (2006.01) |

(56) References Cited

U.S. PATENT DOCUMENTS

| | | | | |
|---|---|---|---|---|
| 5,205,165 | A | 4/1993 | Jardine et al. | |
| 5,465,798 | A | 11/1995 | Edlund et al. | |
| 5,839,090 | A | 11/1998 | Zoraster | |
| 5,842,149 | A * | 11/1998 | Harrell et al. | 702/9 |
| 6,152,246 | A * | 11/2000 | King et al. | 175/26 |
| 6,206,108 | B1 | 3/2001 | MacDonald et al. | |
| 6,208,586 | B1 | 3/2001 | Rorden et al. | |
| 6,233,498 | B1 * | 5/2001 | King et al. | 700/174 |
| 6,418,381 | B1 | 7/2002 | Fuller | |
| 6,820,702 | B2 | 11/2004 | Niedermayr et al. | |
| 6,868,920 | B2 | 3/2005 | Hoteit et al. | |
| 6,892,812 | B2 | 5/2005 | Niedermayr et al. | |
| 6,896,055 | B2 | 5/2005 | Koithan | |
| 6,944,547 | B2 | 9/2005 | Womer et al. | |
| 7,044,237 | B2 | 5/2006 | Leuchtenberg | |
| 7,128,167 | B2 | 10/2006 | Dunlop et al. | |
| 7,526,930 | B2 | 5/2009 | Guidry et al. | |
| 2004/0019427 | A1 | 1/2004 | San Martin et al. | |
| 2004/0040746 | A1 * | 3/2004 | Niedermayr et al. | 175/38 |
| 2004/0124009 | A1 | 7/2004 | Hoteit | |
| 2005/0092523 | A1 | 5/2005 | McCaskill | |
| 2005/0241835 | A1 | 11/2005 | Burris, II et al. | |
| 2005/0269083 | A1 | 12/2005 | Burris, II et al. | |
| 2008/0029306 | A1 * | 2/2008 | Krueger et al. | 175/210 |
| 2008/0128130 | A1 | 6/2008 | Whitsitt et al. | |
| 2008/0228680 | A1 | 9/2008 | Chen et al. | |
| 2008/0234939 | A1 | 9/2008 | Foot et al. | |
| 2008/0262737 | A1 | 10/2008 | Thigpen et al. | |
| 2009/0192731 | A1 | 7/2009 | De Jesus et al. | |
| 2009/0200014 | A1 | 8/2009 | Schottle et al. | |
| 2010/0008190 | A1 | 1/2010 | Gray et al. | |
| 2011/0024189 | A1 | 2/2011 | Saeed et al. | |

FOREIGN PATENT DOCUMENTS

| | | | |
|---|---|---|---|
| GB | 2398091 | A | 8/2004 |
| WO | 03058545 | A1 | 7/2003 |
| WO | 03064812 | A1 | 8/2003 |
| WO | 2007136378 | A1 | 11/2007 |
| WO | 2008106022 | A1 | 9/2008 |
| WO | 2010071656 | A1 | 6/2010 |
| WO | 2011014171 | A1 | 2/2011 |
| WO | 2014018003 | A1 | 1/2014 |

OTHER PUBLICATIONS

International Search Report and Written Opinion issued Sep. 29, 2009, for International Patent Application Serial No. PCT/US09/052227, 8 pages.

Sperry-Sun Drilling Services, Early Warning System, undated, 9 pages.

Australian Examination Report dated Mar. 30, 2015 for Australian Patent Application No. 2011372537 filed on Jul. 5, 2011.

Canadian Office Action dated Apr. 28, 2015 for Canadian Patent Application No. 2841771 filed on Jul. 5, 2011.

Russian Office Action dated Jul. 17, 2015 for Russian Patent Application No. 2014102449 filed on Jul. 5, 2011.

* cited by examiner

EVENT SIGNATURES

| PARAMETERS | KICK | LOSS | CONNECTION STARTED | CONNECTION FINISHED |
|---|---|---|---|---|
| STANDPIPE PRESSURE | DECREASING | INCREASING | DECREASING | INCREASING |
| UPSTREAM CHOKE PRESSURE | DECREASING | INCREASING | DECREASING | INCREASING |
| DOWNSTREAM CHOKE PRESSURE | UNCHANGED | UNCHANGED | DECREASING | INCREASING |
| BELOW BOP PRESSURE | DECREASING | INCREASING | DECREASING | INCREASING |
| ANNULUS PRESSURE | DECREASING | INCREASING | DECREASING | INCREASING |
| BOTTOM HOLE PRESSURE | DECREASING | ERRATIC | DECREASING | INCREASING |
| SEPARATOR PRESSURE | UNCHANGED | UNCHANGED | UNCHANGED | UNCHANGED |
| BACKPRESSURE PUMP PRESSURE | DECREASING | INCREASING | INCREASING | DECREASING |
| UPSTREAM CHOKE TEMPERATURE | DECREASING | UNCHANGED | DECREASING | INCREASING |
| DOWNSTREAM CHOKE TEMPERATURE | DECREASING | UNCHANGED | DECREASING | INCREASING |
| BOTTOMHOLE TEMPERATURE | DECREASING | UNCHANGED | UNCHANGED | INCREASING |
| FLOW IN | UNCHANGED | UNCHANGED | DECREASING | INCREASING |
| FLOW OUT | INCREASING | DECREASING | DECREASING | INCREASING |
| BACKPRESSURE PUMP RATE | DECREASING | INCREASING | INCREASING | DECREASING |
| BIT DEPTH | N/A | N/A | ERRATIC | ERRATIC |
| RATE OF PENETRATION | N/A | N/A | DECREASING | INCREASING |
| HOOKLOAD | INCREASING | N/A | ERRATIC | ERRATIC |
| WEIGHT ON BIT | INCREASING | N/A | DECREASING | INCREASING |
| RPM | UNCHANGED | N/A | DECREASING | INCREASING |
| TORQUE | ERRATIC | N/A | DECREASING | INCREASING |
| CHOKE SIZE | INCREASING | DECREASING | DECREASING | INCREASING |
| PIT VOLUME | INCREASING | DECREASING | UNCHANGED | UNCHANGED |
| TRIP TANK | INCREASING | DECREASING | UNCHANGED | UNCHANGED |
| MUD WEIGHT IN | UNCHANGED | UNCHANGED | UNCHANGED | UNCHANGED |
| MUD WEIGHT OUT | DECREASING | UNCHANGED | UNCHANGED | UNCHANGED |
| FLOW OUT–FLOW IN | INCREASING | DECREASING | DECREASING | INCREASING |

FIG.5

WELL DRILLING METHODS WITH AUTOMATED RESPONSE TO EVENT DETECTION

CROSS-REFERENCE TO RELATED APPLICATIONS

This application claims the benefit under 35 USC §119 of the filing date of international application serial no. PCT/US11/42917, filed 5 Jul. 2011. This application is a continuation-in-part of U.S. application Ser. No. 12/831,716, filed 7 Jul. 2010, which claims priority to international application serial no. PCT/US09/52227, filed 30 Jul. 2009. The entire disclosures of these prior applications are incorporated herein by this reference.

BACKGROUND

The present disclosure relates generally to equipment utilized and operations performed in conjunction with a subterranean well and, in an embodiment described herein, more particularly provides well drilling methods with automated response to event detection.

It is desirable in drilling operations for certain events to be identified as soon as they occur, so that any needed remedial measures may be taken as soon as possible. Events can also be normal, expected events, in which case it would be desirable to be able to control the drilling operations based on identification of such events.

Therefore, it will be appreciated that improvements would be desirable in the art.

BRIEF DESCRIPTION OF THE DRAWINGS

FIG. 5 is a listing of events and corresponding event signatures which may be used in the method of FIG. 2.

DETAILED DESCRIPTION

Figure 1:
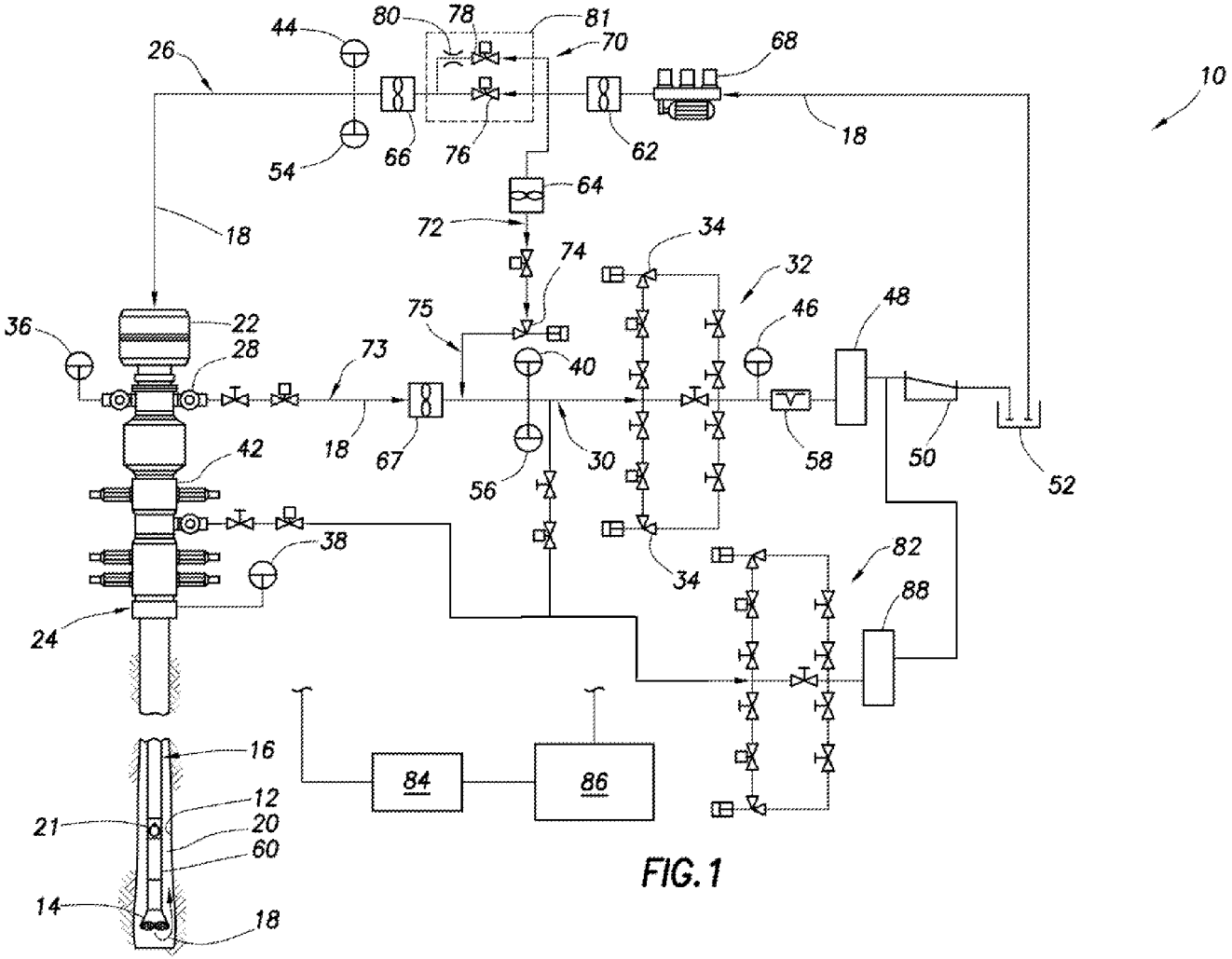
FIG. 1 is a schematic view of a well system which can embody principles of the present disclosure.

Representatively and schematically illustrated in FIG. 1 is a well drilling system 10 and associated method which can incorporate principles of the present disclosure. In the system 10, a wellbore 12 is drilled by rotating a drill bit 14 on an end of a drill string 16. Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16 (e.g., when connections are being made in the drill string).

Control of bottom hole pressure is very important in managed pressure drilling, and in other types of drilling operations. Preferably, the bottom hole pressure is accurately controlled to prevent excessive loss of fluid into the earth formation surrounding the wellbore 12, undesired fracturing of the formation, undesired influx of formation fluids into the wellbore, etc. In typical managed pressure drilling, it is desired to maintain the bottom hole pressure just greater than a pore pressure of the formation, without exceeding a fracture pressure of the formation. In typical underbalanced drilling, it is desired to maintain the bottom hole pressure somewhat less than the pore pressure, thereby obtaining a controlled influx of fluid from the formation.

Nitrogen or another gas, or another lighter weight fluid, may be added to the drilling fluid 18 for pressure control. This technique is useful, for example, in underbalanced drilling operations.

In the system 10, additional control over the bottom hole pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. Although not shown in FIG. 1, the drill string 16 would extend upwardly through the RCD 22 for connection to, for example, a rotary table (not shown), a standpipe line 26, kelley (not shown), a top drive and/or other conventional drilling equipment.

The drilling fluid 18 exits the wellhead 24 via a wing valve 28 in communication with the annulus 20 below the RCD 22. The fluid 18 then flows through drilling fluid return lines 30, 73 to a choke manifold 32, which includes redundant chokes 34 (only one of which may be used at a time). Backpressure is applied to the annulus 20 by variably restricting flow of the fluid 18 through the operative choke (s) 34.

The greater the restriction to flow through the choke 34, the greater the backpressure applied to the annulus 20. Thus, bottom hole pressure can be conveniently regulated by varying the backpressure applied to the annulus 20. A hydraulics model can be used to determine a pressure applied to the annulus 20 at or near the surface which will result in a desired bottom hole pressure, so that an operator (or an automated control system) can readily determine how to regulate the pressure applied to the annulus at or near the surface (which can be conveniently measured) in order to obtain the desired bottom hole pressure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the drilling fluid return lines 30, 73 upstream of the choke manifold 32.

Another pressure sensor 44 senses pressure in the drilling fluid injection (standpipe) line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 64, 66.

Not all of these sensors are necessary. For example, the system 10 could include only two of the three flowmeters 62, 64, 66. However, input from the sensors is useful to the hydraulics model in determining what the pressure applied to the annulus 20 should be during the drilling operation.

Furthermore, the drill string 16 may include its own sensors 60, for example, to directly measure bottom hole pressure. Such sensors 60 may be of the type known to those skilled in the art as pressure while drilling (PWD), measurement while drilling (MWD) and/or logging while drilling (LWD) systems. These drill string sensor systems generally provide at least pressure measurement, and may also provide temperature measurement, detection of drill string characteristics (such as vibration, torque, rpm, weight on bit, stick-slip, etc.), formation characteristics (such as resistivity, density, etc.), fluid characteristics and/or other measurements. Various forms of telemetry (acoustic, pressure pulse, electromagnetic, etc.) may be used to transmit the downhole sensor measurements to the surface.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc. Pressure and level sensors could be used with the separator 48, level sensors could be used to indicate a volume of drilling fluid in the mud pit 52, etc.

Fewer sensors could be included in the system 10, if desired. For example, the output of the rig mud pump 68 could be determined by counting pump strokes, instead of by using flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it via a standpipe manifold 70 to the standpipe 26, the fluid then circulates downward through the drill string 16, upward through the annulus 20, through the drilling fluid return lines 30, 73, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the bottom hole pressure, unless the fluid 18 is flowing through the choke. In conventional overbalanced drilling operations, such a situation will arise whenever a connection is made in the drill string 16 (e.g., to add another length of drill pipe to the drill string as the wellbore 12 is drilled deeper), and the lack of circulation will require that bottom hole pressure be regulated solely by the density of the fluid 18.

In the system 10, however, flow of the fluid 18 through the choke 34 can be maintained, even though the fluid does not circulate through the drill string 16 and annulus 20, while a connection is being made in the drill string. Thus, pressure can still be applied to the annulus 20 by restricting flow of the fluid 18 through the choke 34, even though a separate backpressure pump may not be used.

Instead, the fluid 18 is flowed from the pump 68 to the choke manifold 32 via a bypass line 72, 75 when a connection is made in the drill string 16. Thus, the fluid 18 can bypass the standpipe line 26, drill string 16 and annulus 20, and can flow directly from the pump 68 to the mud return line 30, which remains in communication with the annulus 20. Restriction of this flow by the choke 34 will thereby cause pressure to be applied to the annulus 20.

As depicted in FIG. 1, both of the bypass line 75 and the mud return line 30 are in communication with the annulus 20 via a single line 73. However, the bypass line 75 and the mud return line 30 could instead be separately connected to the wellhead 24, for example, using an additional wing valve (e.g., below the RCD 22), in which case each of the lines 30, 75 would be directly in communication with the annulus 20. Although this might require some additional plumbing at the rig site, the effect on the annulus pressure would be essentially the same as connecting the bypass line 75 and the mud return line 30 to the common line 73. Thus, it should be appreciated that various different configurations of the components of the system 10 may be used, without departing from the principles of this disclosure.

Flow of the fluid 18 through the bypass line 72, 75 is regulated by a choke or other type of flow control device 74. Line 72 is upstream of the bypass flow control device 74, and line 75 is downstream of the bypass flow control device.

Flow of the fluid 18 through the standpipe line 26 is substantially controlled by a valve or other type of flow control device 76. Note that the flow control devices 74, 76 are independently controllable, which provides substantial benefits to the system 10, as described more fully below.

Since the rate of flow of the fluid 18 through each of the standpipe and bypass lines 26, 72 is useful in determining how bottom hole pressure is affected by these flows, the flowmeters 64, 66 are depicted in FIG. 1 as being interconnected in these lines. However, the rate of flow through the standpipe line 26 could be determined even if only the flowmeters 62, 64 were used, and the rate of flow through the bypass line 72 could be determined even if only the flowmeters 62, 66 were used. Thus, it should be understood that it is not necessary for the system 10 to include all of the sensors depicted in FIG. 1 and described herein, and the system could instead include additional sensors, different combinations and/or types of sensors, etc.

A bypass flow control device 78 and flow restrictor 80 may be used for filling the standpipe line 26 and drill string 16 after a connection is made, and equalizing pressure between the standpipe line and mud return lines 30, 73 prior to opening the flow control device 76. Otherwise, sudden opening of the flow control device 76 prior to the standpipe line 26 and drill string 16 being filled and pressurized with the fluid 18 could cause an undesirable pressure transient in the annulus 20 (e.g., due to flow to the choke manifold 32 temporarily being lost while the standpipe line and drill string fill with fluid, etc.).

By opening the standpipe bypass flow control device 78 after a connection is made, the fluid 18 is permitted to fill the standpipe line 26 and drill string 16 while a substantial majority of the fluid continues to flow through the bypass line 72, thereby enabling continued controlled application of pressure to the annulus 20. After the pressure in the standpipe line 26 has equalized with the pressure in the mud return lines 30, 73 and bypass line 75, the flow control device 76 can be opened, and then the flow control device 74 can be closed to slowly divert a greater proportion of the fluid 18 from the bypass line 72 to the standpipe line 26.

Before a connection is made in the drill string 16, a similar process can be performed, except in reverse, to gradually divert flow of the fluid 18 from the standpipe line 26 to the bypass line 72 in preparation for adding more drill pipe to the drill string 16. That is, the flow control device 74 can be gradually opened to slowly divert a greater proportion of the fluid 18 from the standpipe line 26 to the bypass line 72, and then the flow control device 76 can be closed.

Note that the flow control device 78 and flow restrictor 80 could be integrated into a single element (e.g., a flow control device having a flow restriction therein), and the flow control devices 76, 78 could be integrated into a single flow control device 81 (e.g., a single choke which can gradually open to slowly fill and pressurize the standpipe line 26 and drill string 16 after a drill pipe connection is made, and then open fully to allow maximum flow while drilling).

However, since typical conventional drilling rigs are equipped with the flow control device 76 in the form of a valve in the standpipe manifold 70, and use of the standpipe valve is incorporated into usual drilling practices, the individually operable flow control devices 76, 78 are presently preferred. The flow control devices 76, 78 are at times referred to collectively below as though they are the single flow control device 81, but it should be understood that the flow control device 81 can include the individual flow control devices 76, 78.

Note that the system 10 could include a backpressure pump (not shown) for applying pressure to the annulus 20 and drilling fluid return line 30 upstream of the choke manifold 32, if desired. The backpressure pump could be used instead of, or in addition to, the bypass line 72 and flow control device 74 to ensure that fluid continues to flow through the choke manifold 32 during events such as making connections in the drill string 16. In that case, additional sensors may be used to, for example, monitor the pressure and flow rate output of the backpressure pump.

The use of a backpressure pump is described in International Application No. PCT/US10/38586, filed 15 Jun. 2010. That international application also describes a method of correcting an annulus pressure setpoint during drilling.

In other examples, connections may not be made in the drill string 16 during drilling, for example, if the drill string comprises a coiled tubing. The drill string 16 could be provided with conductors and/other lines (e.g., in a sidewall or interior of the drill string) for transmitting data, commands, pressure, etc. between downhole and the surface (e.g., for communication with the sensors 60).

Methods of controlling pressure and flow in drilling operations, including the use of data validation and a predictive device, are described in International Application No. PCT/US10/56433, filed 12 Nov. 2010.

Figure 2:
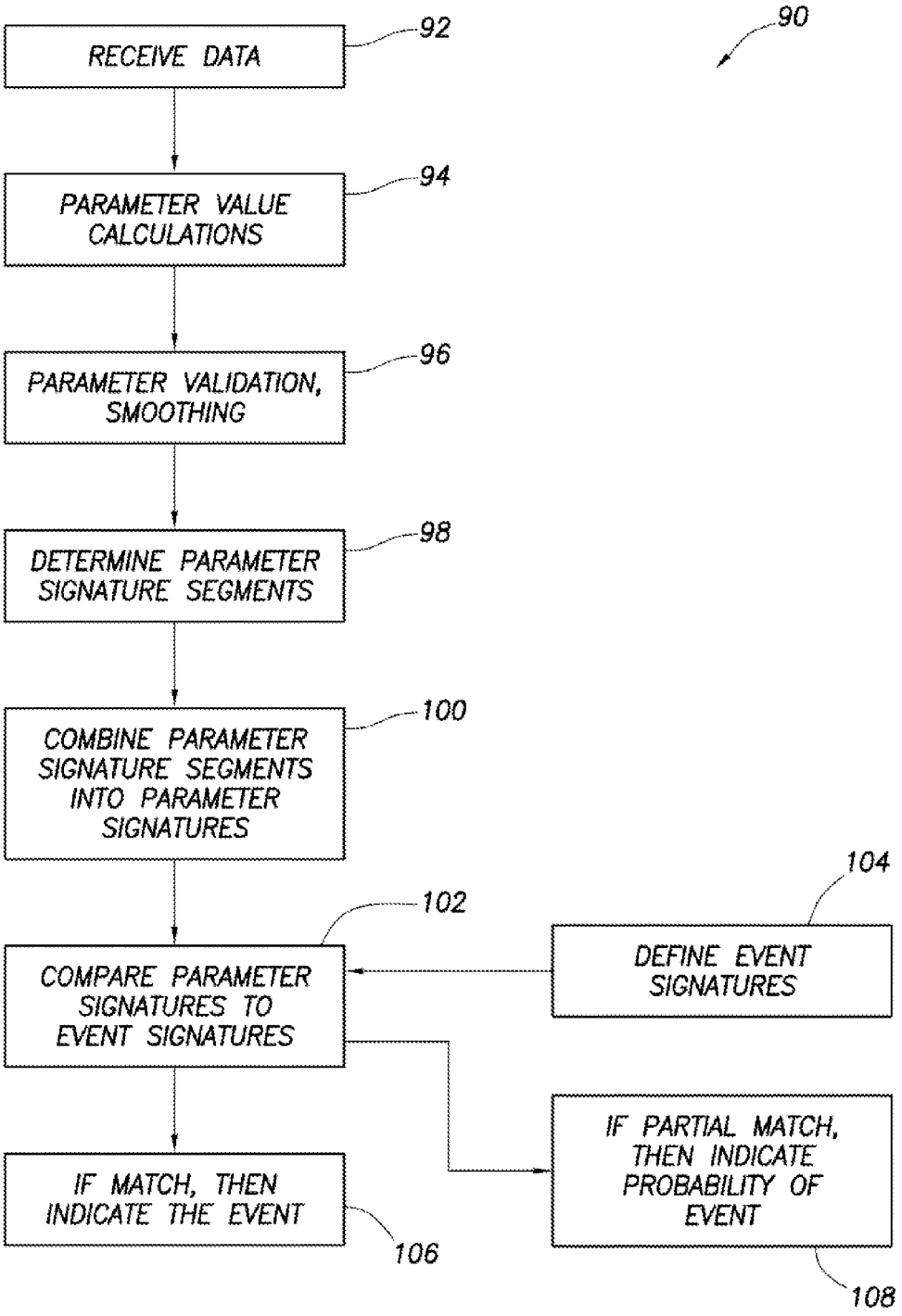
FIG. 2 is a flowchart representing a method which embodies principles of this disclosure.

Referring additionally now to FIG. 2, a well drilling method 90 which may be used with the system 10 of FIG. 1 is schematically illustrated. However, it should be clearly understood that the method 90 could be used in conjunction with other systems in keeping with the principles of this disclosure.

The method 90 includes an event detection process which can be used to alert an operator if an event occurs, such as, by triggering an alarm or displaying a warning if the event is an undesired event (e.g., unacceptable fluid loss to the formation, unacceptable fluid influx from the formation into the wellbore, etc.), or by displaying information about the event if it is a normal, expected or desired event, etc. Well drilling methods incorporating event detection are described in International Application No. PCT/US09/52227, filed 30 Jul. 2009.

An event can be a precursor to another event happening, in which case detection of the first event can be used as an indication that the second event is about to happen or is in process of occurring. In addition, a series of events can also provide an indication that another event is about to happen. Thus, one or more prior events can be used as a source of data for determining if another event will occur.

Many different events and types of events can be detected in the method 90. These events can include, but are not limited to, a kick (influx), partial fluid loss, total fluid loss, standpipe bleed down, plugged choke, washed out choke, poor hole cleaning (wellbore packed off about drill string), downhole crossflow, wellbore washout, under gauged wellbore, drilling break, ballooning while circulating, ballooning while mud pump is off, stuck pipe, twisted off pipe, back off, plugging of bit nozzle, bit nozzle washed out, leak in surface processing equipment, rig pump failure, backpressure pump failure, downhole sensor 60 failure, washed out drill string, non-return valve failure, start of drill pipe connection, drill pipe connection finished, etc.

In order to detect the events, drilling parameter "signatures" produced in real time are compared to a set of event "signatures" in order to determine if any of the events represented by those event signatures is occurring. Thus, what is happening now in the drilling operation (the drilling parameter signatures) is compared to a set of signatures which correspond to drilling events and, if there is a match, this is an indication that the event corresponding to the matched event signature is occurring.

Drilling properties (e.g., pressure temperature, flow rate, etc.) are sensed by sensors, and output from the sensors is used to supply data indicative of the drilling properties. This drilling property data is used to determine drilling parameters of interest.

Data can also be in the form of data from offset wells (e.g., other wells drilled nearby or in similar lithologies, conditions, etc.). Previous experience of drillers can also serve as a source for the data. Data can also be entered by an operator prior to or during the drilling operation.

A drilling parameter can comprise data related to a single drilling property, or a parameter can comprise a ratio, product, difference, sum or other function of data related to multiple drilling properties. For example, it is useful in drilling operations to monitor the difference between the flow rate of drilling fluid injected into the well (e.g., via the standpipe line 26 as sensed by flowmeter 66) and the flow rate of drilling fluid returned from the well (e.g., via the drilling fluid return line 30 as sensed by the flowmeter 67). Thus, a parameter of interest, which can be used to define a part or segment of a signature can be this difference in drilling properties (flow rate in−flow rate out).

During a drilling operation, the drilling properties are sensed over time, either continuously or intermittently. Thus, data related to the drilling properties is available over time, and the behavior of each drilling parameter can be evaluated in real time. Of particular interest in the method 90 is how the drilling parameters change over time, that is, whether each parameter is increasing, decreasing, remaining substantially the same, remaining within a certain range, exceeding a maximum, falling below a minimum, etc.

These parameter behaviors are given appropriate values, and the values are combined to generate parameter signatures indicative of what is occurring in real time during the drilling operation. For example, one segment of a parameter signature could indicate that standpipe pressure (e.g., as measured by sensor 44) is increasing, and another segment of the parameter signature could indicate that pressure upstream of the choke manifold (e.g., as measured by sensor 40) is decreasing.

A parameter signature can include many (perhaps 20 or more) of these segments. Thus, a parameter signature can provide a "snapshot" of what is happening in real time during the drilling operation.

An event signature, on the other hand, does not represent what is occurring in real time during a drilling operation. Instead, an event signature is representative of what the drilling parameter behaviors will be when the corresponding event does happen. Each event signature is distinctive, because each event is indicated by a distinctive combination of parameter behaviors.

As discussed above, an event can be a precursor to another event. In that case, the event signature for the first event can be a distinctive combination of parameter behaviors which indicate that the second event is about to (or at least is eventually going to) happen.

Events can be parameters, for example, in the circumstance discussed above in which a series of events can indicate that another event is going to happen. In that case, the corresponding parameter behavior can be whether or not the precursor event(s) have happened.

Event signatures can be generated prior to commencing a drilling operation, and can be based on experience gained from drilling similar wells under similar conditions, etc. Event signatures can also be refined as a drilling operation progresses and more experience is gained on the well being drilled.

In basic terms, sensors are used to sense drilling properties during a drilling operation, data relating to the sensed properties are used to determine drilling parameters of interest, values indicative of the behaviors of these parameters are combined to form parameter signatures, and the parameter signatures are compared to pre-defined event signatures to detect whether any of the corresponding events is occurring, or is substantially likely to occur.

Steps in the event detection process are schematically represented in FIG. 2 in flowchart form. However, it should be understood that the method 90 can include additional, alternative or optional steps as well, and it is not necessary for all of the depicted steps to be performed in keeping with the principles of this disclosure.

In a first step 92 depicted in FIG. 2, data is received. The data in this example is received from a central database, such as an INSITE™ database utilized by Halliburton Energy Services, Inc. of Houston, Tex. USA, although other databases may be used if desired.

The data typically is in the form of measurements of drilling properties as sensed by various sensors during a drilling operation. For example, the sensors 36, 38, 40, 44, 46, 54, 56, 58, 60, 62, 64, 66, 67, as well as other sensors, will produce indications of various properties (such as pressure, temperature, mass or volumetric flow rate, density, resistivity, rpm, torque, weight, position, etc.), which will be stored as data in the database. Calibration, conversion and/or other operations may be performed for the data prior to the data being received from the database.

The data may also be entered manually by an operator. As another alternative, data can be received directly from one or more sensors, or from another data acquisition system, whether or not the data originates from sensor measurements, and without first being stored in a separate database. Furthermore, as discussed above, the data can be derived from an offset well, previous experience, etc. Any source for the data may be used, in keeping with the principles of this disclosure.

In step 94, various parameter values are calculated for later use in the method 90. For example, it may be desirable to calculate a ratio of data values, a sum of data values, a difference between data values, a product of data values, etc. In some instances, however, the value of the data itself is used as is, without any further calculation.

In step 96, the parameter values are validated and smoothing techniques may be used to ensure that meaningful parameter values are utilized in the later steps of the method 90. For example, a parameter value may be excluded if it represents an unreasonably high or low value for that parameter, and the smoothing techniques may be used to prevent unacceptably large parameter value transitions from distorting later analysis. A parameter value can correspond to whether or not another event has occurred, as discussed above.

In step 98, the parameter signature segments are determined. This step can include calculating values indicative of the behaviors of the parameters. For example, if a parameter has an increasing trend, a value of 1 may be assigned to the corresponding parameter signature segment, if a parameter has a decreasing trend, a value of 2 may be assigned to the segment, if the parameter is unchanged, a value of 0 may be assigned to the segment, etc. To determine the behavior of a parameter, statistical calculations (algorithms) may be applied to the parameter values resulting from step 96.

Comparisons between parameters may also be made to determine a particular signature segment. For example, if one parameter is greater than another parameter, a value of 1 may be assigned to the signature segment, if the first parameter is less than the second parameter, a value of 2 may be assigned, if the parameters are substantially equal, a value of 0 may be assigned, etc.

In step 100, the parameter signature segments are combined to make up the parameter signatures. Each parameter signature is a combination of parameter signature segments and represents what is happening in real time in the drilling operation.

In step 102, the parameter signatures are compared to the previously defined event signatures to see if there is a match. Since data is continuously (or at least intermittently) being generated in real time during a drilling operation, corresponding parameter signatures can also be generated in the method 90 in real time for comparison to the event signatures. Thus, an operator can be informed immediately during the drilling operation whether an event is occurring.

Step 104 represents defining of the event signatures which, as described above, can be performed prior to and/or during the drilling operation. Example event signatures are provided in FIG. 5, and are discussed in further detail below.

In step 106, an event is indicated if there is a match between an event signature and a parameter signature. An indication can be provided to an operator, for example, by displaying on a computer screen information relating to the event, displaying an alert, sounding an alarm, etc. Indications can also take the form of recording the occurrence of the event in a database, computer memory, etc. A control system can also, or alternatively, respond to an indication of an event, as described more fully below.

In step 108, a probability of an event occurring is indicated if there is a partial match between an event signature and a parameter signature. For example, if an event signature comprises a combination of 30 parameter behaviors, and a parameter signature is generated in which 28 or 29 of the parameter behaviors match those of the event signature, there may be a high probability that the event is occurring, even though there may not be a complete match between the parameter signature and the event signature. It could be useful to provide an indication to an operator in this circumstance that the probability that the event is occurring is high.

Another useful indication would be of the probability of the event occurring in the future. For example if, as in the example discussed above, a substantial majority of the parameter behaviors match between the parameter signature and the event signature, and the unmatched parameter behaviors are trending toward matching, then it would be useful (particularly if the event is an undesired event) to warn an operator that the event is likely to occur, so that remedial measures may be taken if needed (for example, to prevent an undesired event from occurring).

Figure 3:
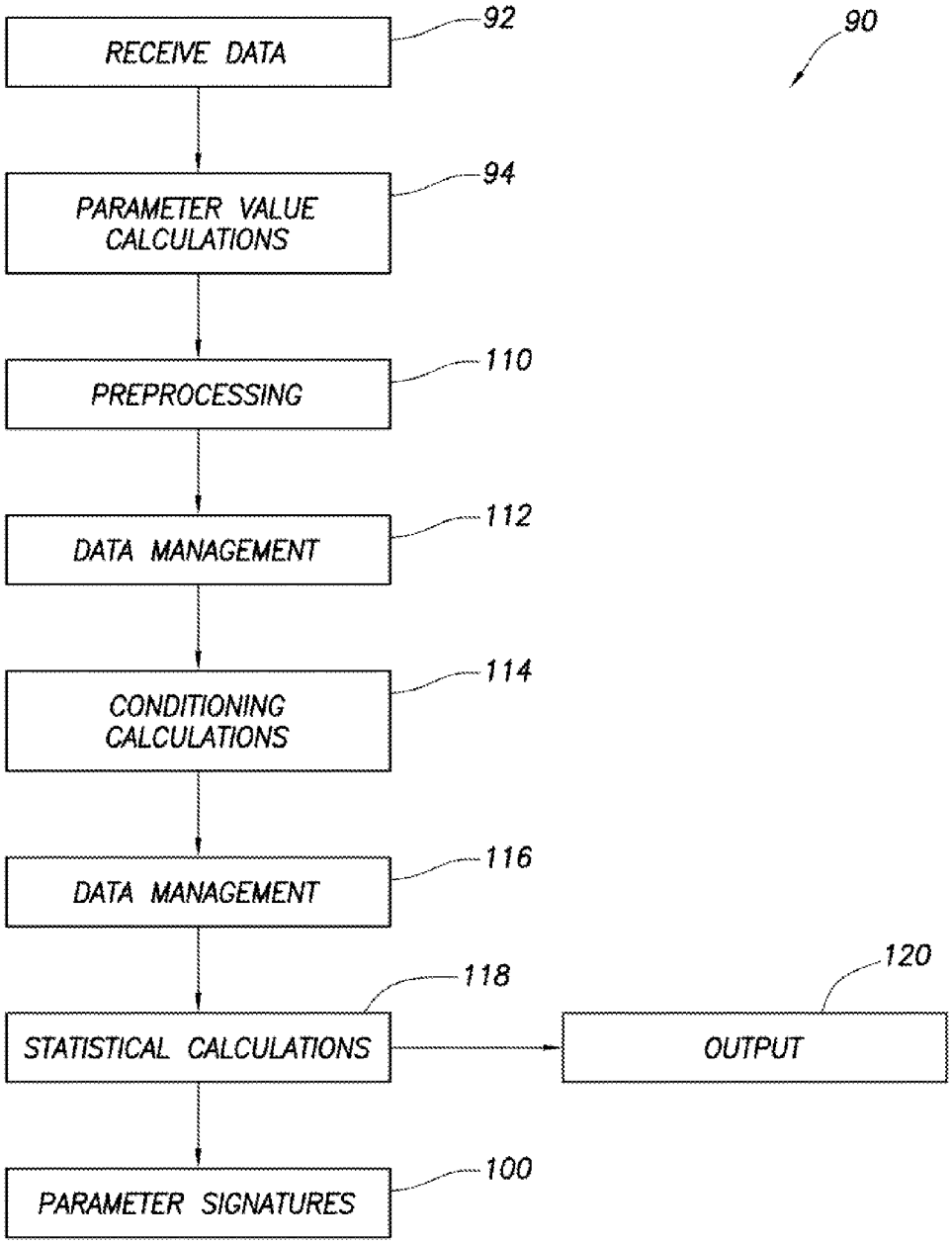
FIG. 3 is a flowchart of an example of a parameter signature generation process which may be used in the method of FIG. 2.

Referring additionally now to FIG. 3, a flowchart of another example of the process of generating the parameter signatures in the method 90 is representatively illustrated. The process begins with receiving the data as in step 92 described above. Parameter value calculations are then performed as in step 94 described above.

In step 110, preprocessing operations are performed for the parameter values. For example, maximum and minimum limits may be used for particular parameters, in order to exclude erroneously high or low values of the parameters.

In step 112, the preprocessed parameter values are stored in a data buffer. The data buffer is used to queue up the parameter values for subsequent processing.

In step 114, conditioning calculations are performed for the parameter values. For example, smoothing may be used (such as, moving window average, Savitzky-Golay smoothing, etc.) as discussed above in relation to step 96.

In step 116, the conditioned parameter values are stored in a data buffer.

In step 118, statistical calculations are performed for the parameter values. For example, trend analysis (such as, straight line fit, determination of trend direction over time, first and second order derivatives, etc.) may be used to characterize the behavior of a parameter. Values assigned to the parameter behaviors become segments of the resulting parameter signatures, as discussed above for step 98.

In step 120, the parameter signature segments are output to the database for storage, subsequent analysis, etc. In this example, the parameter signature segments become part of the INSITE™ database for the drilling operation.

In step 100, as discussed above, the parameter signature segments are combined to form the parameter signatures.

Figure 4:
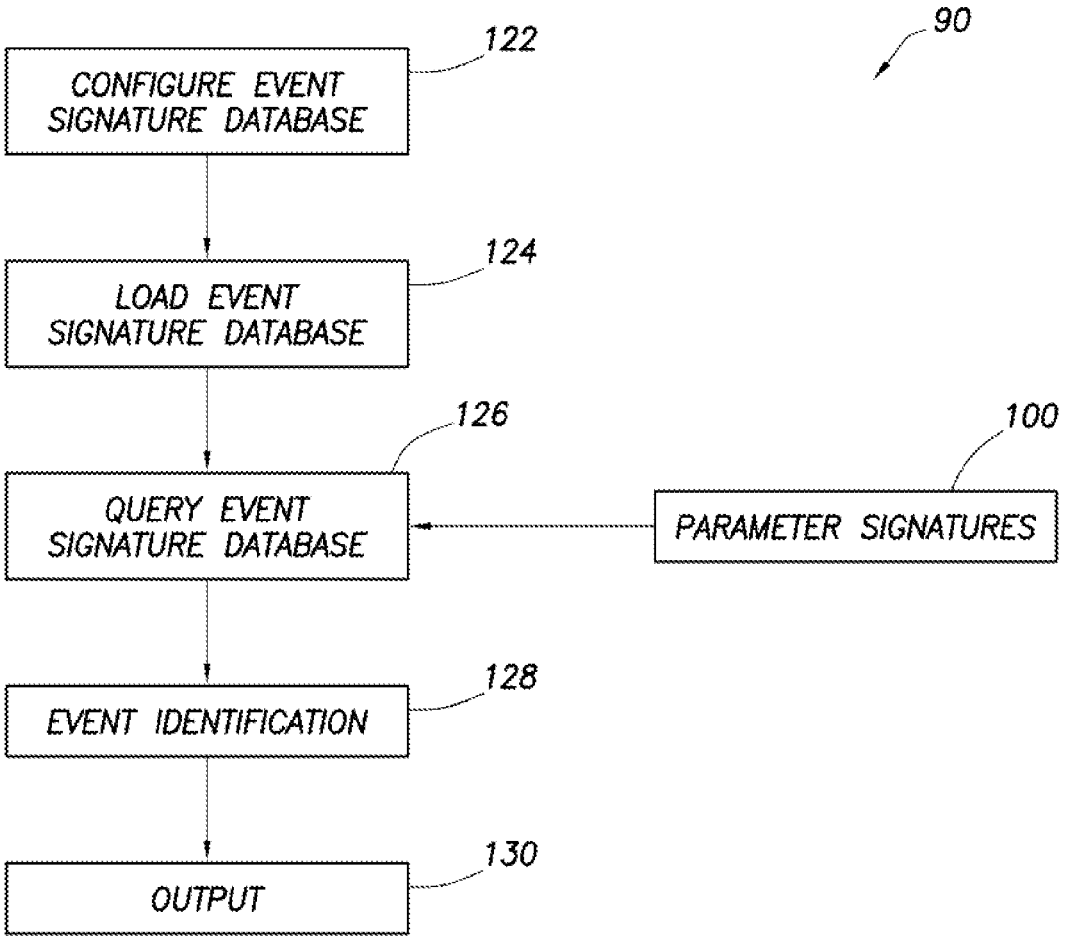
FIG. 4 is a flowchart of an example of an event signature generation and event identification process which may be used in the method of FIG. 2.

Referring additionally now to FIG. 4, a flowchart of a process for identifying that an event has occurred, or will occur, in the method 90 is representatively illustrated. The process begins with step 122, in which an event signature database is configured. The database can be configured to include any number of event signatures to enable any number of corresponding events to be identified during a drilling operation. Preferably, the event signature database can be separately configured for different types of drilling operations, such as underbalanced drilling, overbalanced drilling, drilling in particular lithologies, etc.

In step 124, a desired set of event signatures are loaded into the event signature database. As discussed above, any number, type and/or combination of event signatures may be used in the method 90.

In step 126, the event signature database is queried to see if there are any matches to the parameter signatures generated in step 100. As discussed above, partial matches may optionally be identified, as well.

In step 128, events are identified which correspond to event signatures which match (or at least partially match) any parameter signatures. The output in step 130 can take various different forms, which may depend upon the identified event. An alarm, alert, warning, display of information, etc. may be provided as discussed above for step 106. At a minimum, occurrence of the event should be recorded, and in this example preferably is recorded, as part of the INSITE™ database for the drilling operation.

Referring additionally now to FIG. 5, four example event signatures are representatively tabulated, along with parameter behaviors which correspond to the segments of the signatures. In practice, many more event signatures may be provided, and more or less parameter behaviors may be used for determining the signature segments.

Note that each event signature is distinctive. Thus, a kick (influx) event is indicated by a particular combination of parameter behaviors, whereas a fluid loss event is indicated by another particular combination of parameter behaviors.

If, during a drilling operation, a parameter signature is generated which matches (or at least partially matches) any of the event signatures shown in FIG. 5, an indication will be provided that the corresponding event is occurring. If a parameter signature is generated which matches an event signature to a predetermined level, or if the parameter signature's segments are trending toward matching, then an indication may be provided that the corresponding event is substantially likely to occur. This can happen even without any human intervention, resulting in a more automated, precise and safe drilling environment.

The event indications provided by the method 90 can also be used to control the drilling operation. For example, if a kick event is indicated, the operative choke(s) 34 can be adjusted in response to increase pressure applied to the annulus 20 in the system 10. If fluid loss is detected, the choke(s) 34 can be adjusted to decrease pressure applied to the annulus 20. If a drill pipe connection is starting, the flow control devices 81, 74 can be appropriately adjusted to maintain a desired pressure in the annulus 20 during the connection process, and when completion of the drill pipe connection is detected, the flow control devices can be appropriately adjusted to restore circulation flow through the drill string 16 in preparation for drilling ahead.

These and other types of control over the drilling operation can be implemented based on detection of the corresponding events using the method 90 automatically and without human intervention, if desired. In one example, a control system such as that described in International Application No. PCT/US08/87686 may be used for implementing the control over the drilling operation.

In some embodiments, human intervention could be used, for example, to determine whether the control over the drilling operation should be implemented in response to detection of events in the method 90. Thus, if an event is detected (or if the event is indicated as being likely to happen), a human's authorization may be required before the drilling operation is automatically controlled in response.

As depicted in FIG. 1, a controller 84 (such as a programmable logic controller or another type of controller capable of controlling operation of drilling equipment) is connected to a control system 86 (such as the control system described in International Application No. PCT/US08/87686, or as described in International Application No. PCT/US10/56433). The controller 84 is also connected to the flow control devices 34, 74, 81 for regulating flow injected into the drill string 16, flow through the drilling fluid return line 30, and flow between the standpipe injection line 26 and the return line 30.

The control system 86 can include various elements, such as one or more computing devices/processors, a hydraulic model, a wellbore model, a database, software in various formats, memory, machine-readable code, etc. These elements and others may be included in a single structure or location, or they may be distributed among multiple structures or locations.

The control system 86 is connected to the sensors 36, 38, 40, 44, 46, 54, 56, 58, 60, 62, 64, 66, 67 which sense respective drilling properties during the drilling operation. As discussed above, offset well data, previous operator experience, other operator input, etc., may also be input to the control system 86. The control system 86 can include software, programmable and preprogrammed memory, machine-readable code, etc. for carrying out the steps of the method 90 described above.

The control system 86 may be located at the wellsite, in which case the sensors 36, 38, 40, 44, 46, 54, 56, 58, 60, 62, 64, 66, 67 could be connected to the control system by wires or wirelessly. Alternatively, the control system 86 could be located at a remote location, in which case the control system could receive data via satellite transmission, the Internet, wirelessly, or by any other appropriate means. The controller 84 can also be connected to the control system 86 in various ways, whether the control system is locally or remotely located.

In one example, the control system 86 can cause one or any number of the chokes 34 to close (e.g., increasingly restrict flow of the fluid 18 through the return line 30) by a predetermined amount automatically in response to the step 130 output indicating that a kick (influx) has occurred, or is substantially likely to occur. For example, if the parameter signature matches (or substantially matches) the event signature for a kick, then the control system 86 will operate the controller 84 to close the operative choke(s) 34 by the predetermined amount (e.g., a percentage of the choke's operating range, such as 1%-10% of that range).

The predetermined amount could be preprogrammed into the control system 86, and/or the predetermined amount could be input, for example, via a human-machine interface. After the choke(s) 34 have been closed the predetermined amount, control over operation of the choke(s) 34 can be returned to an automated system whereby a wellbore or standpipe pressure set point is maintained (which set point may be obtained, e.g., from a hydraulics model or manual input), the choke(s) can be manually operated, or another manner of controlling the choke(s) can be implemented.

In another example, the control system 86 can cause one or any number of the chokes 34 to open (e.g., decrease restriction to flow of the fluid 18 through the return line 30) by a predetermined amount automatically in response to the step 130 output indicating that a fluid loss has occurred, or is substantially likely to occur. For example, if the parameter signature matches (or substantially matches) the event signature for a fluid loss, then the control system 86 will operate the controller 84 to open the operative choke(s) 34 by the predetermined amount (e.g., a percentage of the choke's operating range, such as 1%-10% of that range).

The predetermined amount could be preprogrammed into the control system 86, and/or the predetermined amount could be input, for example, via a human-machine interface. After the choke(s) 34 have been opened the predetermined amount, control over operation of the choke(s) 34 can be returned to the automated system whereby the wellbore or standpipe pressure set point is maintained (which set point may be obtained, e.g., from a hydraulics model or manual input), the choke(s) can be manually operated, or another manner of controlling the choke(s) can be implemented.

In another example, the control system 86 can provide an alert or an alarm to an operator that a particular event has occurred, or is substantially likely to occur. The operator can then take any needed remedial actions based on the alert/alarm, or can override any actions taken by the control system 86 automatically in response to the step 130 output. If action has already been taken by the control system 86, the operator can undo or reverse such actions, if desired.

In another example, the control system 86 can switch between maintaining a desired wellbore pressure to maintaining a desired standpipe pressure in response to the step 130 output indicating that an event has occurred, or is substantially likely to occur. A technique by which a control system can maintain a wellbore pressure is described in International Application Nos. PCT/US10/38586 and PCT/US10/56433, and a technique by which a control system can maintain a standpipe pressure is described in International Application No. PCT/US11/31767.

The control system 86 can switch between such wellbore pressure set point and standpipe 26 pressure set point modes automatically in response to the step 130 output indicating that an event has occurred, or is substantially likely to occur. For example, if a kick (influx) event is detected, the control system 86 can switch from maintaining a desired wellbore 12 pressure to maintaining a desired standpipe 26 pressure. This switch may actually be performed after verifying that conditions are acceptable for making the switch, and after providing an operator with an option (such as, via a displayed alert) to initiate the switch.

In another example, the control system 86 can automatically provide an operator (such as a driller) with instructions or guidance for what remedial measures to take in response to the step 130 output indicating that an event has occurred or is substantially likely to occur. The instructions or guidance may be provided by a local well site display, and/or may be transmitted between the well site and a remote location, etc.

In another example, the control system 86 can implement a well control procedure automatically in response to the step 130 output indicating that an event has occurred, or is substantially likely to occur. The well control procedure could include routing return flow of the fluid 18 to a conventional rig choke manifold 82 and gas buster 88 (see FIG. 1) designed for handling well control situations.

Alternatively, the well control procedure could include the control system 86 automatically operating the choke manifold 32 to optimally circulate out an undesired influx. An example of automated operation of a choke manifold to circulate out an undesired influx is described in International Application No. PCT/US10/20122, filed 5 Jan. 2010.

In another example, the control system 86 can manipulate a choke 34 (e.g., alternately open and close the choke a certain amount, etc.) automatically in response to the step 130 output indicating that the choke is plugged, or is substantially likely to become plugged. The choke 34 plugging event can be represented by an event signature which, for example, includes a parameter segment indicating increasing pressure differential across the choke. The manipulation of the choke 34 automatically in response to the step 130 output can potentially dislodge whatever has plugged or is increasingly plugging the choke.

In another example, the control system 86 can switch flow of the fluid 18 from one of the chokes 34 to another of the chokes automatically in response to the step 130 output indicating that one of the chokes has become plugged, washed out, locked or otherwise compromised, or is substantially likely to become so compromised. The switching from one choke 34 to another can be performed progressively and automatically, so that a desired wellbore pressure or standpipe pressure can also be maintained by the control system 86 during the switching.

The control system 86 can switch flow of the fluid 18 from one of the chokes 34 to another of the chokes automatically in response to the step 130 output indicating that the fluid 18 flow is out of, or is substantially likely to become out of, an optimum operating range of one of the chokes. The chokes 34 can have different trim sizes, so that the chokes have different optimum operating ranges. When the flow of the fluid 18 is outside of the optimum operating range of the choke 34 being used to variably restrict the flow, it can be beneficial to switch the flow to another of the chokes having an optimum operating range which better matches the flow.

The control system 86 can open an additional choke 34 automatically in response to the step 130 output indicating that an operating range of the operative choke is exceeded, or is substantially likely to be exceeded, by the flow of the fluid 18. By increasing the number of operative chokes 34 through which the fluid 18 flows, the flow through each choke is reduced, so that the operating range of each choke is not exceeded.

In another example, the control system 86 can modify or correct a pressure set point (e.g., received from a hydraulics model) automatically in response to the step 130 output indicating that: a) a sensor (such as the sensor 60, a pressure while drilling (PWD) tool, etc.) has failed or is substantially likely to fail, b) the drill string 16 has parted (e.g., twisted off, disconnected, backed off, etc.) downhole or is substantially likely to do so, and/or c) an influx or loss event has occurred or is substantially likely to occur, making adjustment of fluid 18 density in the wellbore desirable in models, such as the hydraulics model and/or a well model. The control system 86 can operate the controller 84 using the modified/corrected set point, instead of the set point received from, e.g., the hydraulics model. The control system 86 can update the hydraulics and/or well model(s) with revised fluid 18 density based on the detection of the fluid influx or loss event.

In another example, the control system 86 can automatically communicate to the hydraulics and/or well model(s) that an event has been detected. For example, if the event is a failure of the sensor 60 (such as a PWD sensor, etc.), the control system 86 can automatically communicate this to the hydraulics model, which will cease correcting the pressure set point based on actual measurements from the sensor. As another example, if the event is parting of the drill string 16, the control system 86 can automatically communicate this to the hydraulics and/or well model(s), which will adjust a volume of the annulus 20 and/or other parameters in the model(s).

In another example, the control system 86 can open one or more of the previously inoperative chokes 34 automatically in response to the step 130 output indicating that excessive pressure exists in the wellbore 12, or at least upstream of the choke manifold 32. A maximum pressure can be preprogrammed into the control system 86 so that, if the maximum pressure is exceeded, one or more of the chokes 34 will be opened by the controller 84 to relieve the excess pressure.

In another example, the control system 86 can divert flow to a rig choke manifold 82, or another choke manifold similar to the choke manifold 32, automatically in response to the step 130 output indicating that a sealing element of the RCD 22 has failed, or is substantially likely to fail. The control system 86 could also automatically open the choke (s) 34 a desired amount, to thereby relieve pressure under the RCD 22.

In another example, the control system 86 can modify an annulus 20 volume used by the hydraulics and/or well model(s) automatically in response to the step 130 output indicating that a floating rig is heaving. For example, the control system 86 could receive indications of rig heave from a conventional motion compensation system of the floating rig. The annulus 20 volume can be modified/corrected by the control system 86 automatically in response to indications that the rig has risen or fallen, thereby enabling the wellbore or standpipe pressure set point to be updated based on the modified/corrected annulus volume.

It may now be fully appreciated that the above disclosure provides many benefits to the art of well drilling and event detection during drilling operations. The methods described above enable drilling events to be detected accurately and in real time, so that appropriate actions may be taken if needed. The control system 86 can automatically perform the appropriate actions (such as, providing an alert or alarm, controlling operation of the chokes 34, controlling operation of various flow control devices, etc.) in response to an indication that a particular drilling event has occurred, or is substantially likely to occur.

In particular, the above disclosure provides to the art a well drilling method 90 which can include the steps of detecting a drilling event by comparing a parameter signature generated during drilling to an event signature indicative of the drilling event, and automatically controlling a drilling operation in response to at least a partial match resulting from comparing the parameter signature to the event signature.

Automatically controlling may include automatically adjusting a choke 34 in response to the detecting.

The drilling event may comprise an influx, and automatically controlling may include automatically closing a choke 34 a predetermined amount in response to detecting the influx.

The drilling event may comprise a fluid 18 loss, and automatically controlling may include automatically opening a choke 34 a predetermined amount in response to detecting the fluid 18 loss.

The detecting step may include detecting that the drilling event has occurred, or is substantially likely to occur.

The drilling event may comprise a start or a completion of a drill pipe connection process. Automatically controlling may include automatically restoring circulation flow through a drill string 16 in response to detecting the completion of the drill pipe connection process.

Automatically controlling may include automatically switching between a) maintaining a desired wellbore 12 pressure, and b) maintaining a desired standpipe 26 pressure.

The drilling event may comprise an influx.

Automatically controlling may include automatically implementing a well control procedure. The well control procedure may comprise diverting fluid 18 flow to a rig choke manifold 82, automatically circulating an undesired influx out of a well, and/or automatically operating a choke manifold 32, thereby circulating an undesired influx out of the well.

The drilling event may comprise plugging of a choke 34, and automatically controlling may include automatically manipulating the choke 34. Manipulating the choke 34 may include alternately opening and closing the choke 34.

Automatically controlling may include automatically switching flow from a first choke 34 to a second choke 34. The drilling event may comprise flow through the first choke 34 being outside of an optimum operating range of the first choke 34, the first choke 34 being compromised, the first choke 34 being locked, the first choke 34 being plugged, and/or the first choke 34 being washed out. Switching flow may include automatically maintaining a desired pressure during the switching.

The drilling event may comprise exceeding an operating range of one or more operative chokes 34, and automatically controlling may include automatically increasing a number of the operative chokes 34.

The drilling event may comprise failure of a rotating control device 22 seal. Automatically controlling may include automatically diverting flow to a rig choke manifold 82, and/or opening a choke 34 a predetermined amount, thereby increasingly relieving pressure across the rotating control device 22.

Automatically controlling may include communicating rig heave information to a model.

The drilling event may comprise rig heave. Automatically controlling may include automatically adjusting annulus 20 volume, and/or automatically updating a pressure set point.

The drilling event may comprises failure of a sensor 36, 38, 40, 44, 46, 54, 56, 58, 60, 62, 64, 66, 67. Automatically controlling may include communicating the sensor 36, 38, 40, 44, 46, 54, 56, 58, 60, 62, 64, 66, 67 failure to a model.

Automatically controlling the drilling operation may be performed further in response to human authorization of such automatic control of the drilling operation.

Also described above is a well drilling system 10. The well drilling system 10 may include a control system 86 which compares a parameter signature for a drilling operation to an event signature indicative of a drilling event, and a controller 84 which controls the drilling operation automatically in response to the drilling event being indicated by at least a partial match between the parameter signature and the event signature.

The controller 84 may automatically adjust a choke 34 in response to the drilling event being indicated.

The drilling event may comprise an influx, and the controller 84 may automatically close a choke 34 a predetermined amount in response to the influx being indicated.

The drilling event may comprise a fluid 18 loss, and the controller 84 may automatically open a choke 34 a predetermined amount in response to the fluid 18 loss being indicated.

The at least partial match may indicate that the drilling event has occurred, or that the drilling event is substantially likely to occur.

The drilling event comprises a start or a completion of a drill pipe connection. The controller 84 may automatically restore circulation flow through a drill string 16.

The control system 86 may automatically switch between a) maintenance of a desired wellbore pressure, and b) maintenance of a desired standpipe pressure.

The drilling event may comprise an influx. The control system 86 may automatically implement a well control procedure. The well control procedure may comprise diversion of fluid 18 flow to a rig choke manifold 82, automatic circulation of an undesired influx out of a well, and/or automatic operation of a choke manifold 32, whereby the undesired influx is circulated out of the well.

The drilling event may comprise a choke 34 being plugged, and the controller 84 may automatically manipulate the choke 34. Manipulation of the choke 34 may comprise alternately opening and closing the choke 34.

The control system 86 may automatically switch flow from a first choke 34 to a second choke 34. The drilling event may comprise flow through the first choke 34 being outside of an optimum operating range of the first choke 34, or the first choke 34 being compromised, locked, plugged, and/or washed out. The control system 86 may automatically maintain a desired pressure while the flow is switched from the first choke 34 to the second choke 34.

The drilling event may comprise an operating range of one or more operative chokes 34 being exceeded, and the control system 86 may automatically increase a number of the operative chokes 34.

The drilling event may comprise failure of a rotating control device 22 seal. The control system 86 may automatically divert flow to a rig choke manifold 82, and/or automatically open a choke 34 a predetermined amount, whereby pressure across the rotating control device 22 is increasingly relieved.

The control system 86 may automatically communicate rig heave information to a model.

The drilling event may comprise rig heave. The control system 86 may automatically adjust annulus 20 volume, and/or automatically update a pressure set point.

The drilling event may comprises failure of a sensor 36, 38, 40, 44, 46, 54, 56, 58, 60, 62, 64, 66, 67. The control system 86 may automatically communicate the sensor 36, 38, 40, 44, 46, 54, 56, 58, 60, 62, 64, 66, 67 failure to a model.

The control system 86 may provide an alert, an alarm, guidance to an operator, and/or at least one option for response to the drilling event being indicated.

The controller 84 may control the drilling operation automatically further in response to human authorization of such control of the drilling operation.

It is to be understood that the various embodiments of the present disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the present invention being limited solely by the appended claims and their equivalents.

What is claimed is:

1. A well drilling method for drilling a well, comprising:
monitoring a drilling parameter during drilling;
generating a parameter signature based on how the drilling parameter changes over time;
comparing the parameter signature to an event signature indicative of a drilling event;
detecting the drilling event will occur if the parameter signature is a partial match with the event signature; and
automatically controlling a drilling operation in response to the detecting.

2. The method of claim 1, wherein automatically controlling further comprises automatically adjusting a choke in response to the comparing.

3. The method of claim 1, wherein the drilling event comprises an influx, and wherein automatically controlling further comprises automatically closing a choke a predetermined amount in response to detecting that the influx will occur.

4. The method of claim 1, wherein the drilling event comprises a fluid loss, and wherein automatically controlling further comprises automatically opening a choke a predetermined amount in response to detecting that the fluid loss will occur.

5. The method of claim 1, wherein automatically controlling further comprises automatically restoring circulation flow through a drill string.

6. The method of claim 1, wherein automatically controlling further comprises automatically switching between a) maintaining a desired wellbore pressure, and b) maintaining a desired standpipe pressure.

7. The method of claim 6, wherein the drilling event comprises an influx.

8. The method of claim 1, wherein automatically controlling further comprises automatically implementing a well control procedure.

9. The method of claim 8, wherein the well control procedure comprises diverting fluid flow to a rig choke manifold.

10. The method of claim 8, wherein automatically implementing the well control procedure further comprises automatically circulating an undesired influx out of the well.

11. The method of claim 8, wherein automatically implementing the well control procedure further comprises automatically operating a choke manifold, thereby circulating an undesired influx out of the well.

12. The method of claim 1, wherein the drilling event comprises plugging of a choke, and wherein automatically controlling further comprises automatically manipulating the choke in response to detecting that the plugging of the choke will occur.

13. The method of claim 12, wherein manipulating the choke further comprises alternately opening and closing the choke.

14. The method of claim 1, wherein automatically controlling further comprises automatically switching flow from a first choke to a second choke.

15. The method of claim 14, wherein the drilling event comprises flow through the first choke being outside of an optimum operating range of the first choke.

16. The method of claim 14, wherein the drilling event comprises the first choke being compromised.

17. The method of claim 14, wherein the drilling event comprises the first choke being locked.

18. The method of claim 14, wherein the drilling event comprises the first choke being plugged.

19. The method of claim 14, wherein the drilling event comprises the first choke being washed out.

20. The method of claim 14, wherein switching flow further comprises automatically maintaining a desired pressure during the switching.

21. The method of claim 1, wherein the drilling event comprises exceeding an operating range of one or more operative chokes, and wherein automatically controlling further comprises automatically increasing a number of the operative chokes in response to detecting that the exceeding of the operating range of the one or more operative chokes will occur.

22. The method of claim 1, wherein the drilling event comprises failure of a rotating control device seal.

23. The method of claim 22, wherein automatically controlling further comprises automatically diverting flow to a rig choke manifold in response to detecting that the failure of the rotating control device seal will occur.

24. The method of claim 22, wherein automatically controlling further comprises opening a choke a predetermined amount, thereby increasingly relieving pressure across the rotating control device in response to detecting that the failure of the rotating control device seal will occur.

25. The method of claim 1, wherein automatically controlling further comprises communicating rig heave information to a model.

26. The method of claim 1, wherein the drilling event comprises rig heave.

27. The method of claim 26, wherein automatically controlling further comprises automatically adjusting annulus volume in response to detecting that the rig heave will occur.

28. The method of claim 26, wherein automatically controlling further comprises automatically updating a pressure set point in response to detecting that the rig heave will occur.

29. The method of claim 1, wherein automatically controlling is performed in response to human authorization of such automatic control of the drilling operation.

30. A well drilling system for drilling a well, comprising:

a control system configured to monitor a drilling parameter during drilling and generate a parameter signature based on how the drilling parameter changes over time;

the control system further configured to compare the parameter signature to an event signature indicative of a drilling event;

the control system further configured to detect that the drilling event will occur if the parameter signature is a partial match with the event signature; and a controller configured to automatically control a drilling operation in response to detecting that the drilling event will occur.

31. The system of claim 30, wherein the controller automatically adjusts a choke in response to detecting that the drilling event will occur.

32. The system of claim 30, wherein the drilling event comprises an influx, and wherein the controller automatically closes a choke a predetermined amount in response to detecting that the influx will occur.

33. The system of claim 30, wherein the drilling event comprises a fluid loss, and wherein the controller automatically opens a choke a predetermined amount in response to detecting that the fluid loss will occur.

34. The system of claim 30, wherein the control system automatically switches between a) maintenance of a desired wellbore pressure, and b) maintenance of a desired standpipe pressure.

35. The system of claim 34, wherein the drilling event comprises an influx.

36. The system of claim 30, wherein the control system automatically implements a well control procedure.

37. The system of claim 36, wherein the well control procedure comprises diversion of fluid flow to a rig choke manifold.

38. The system of claim 36, wherein the well control procedure comprises automatic circulation of an undesired influx out of the well.

39. The system of claim 36, wherein the well control procedure comprises automatic operation of a choke manifold, whereby an undesired influx is circulated out of the well.

40. The system of claim 30, wherein the drilling event comprises a choke being plugged, and wherein the controller automatically manipulates the choke in response to detecting that the choke being plugged will occur.

41. The system of claim 40, wherein manipulation of the choke comprises alternately opening and closing the choke.

42. The system of claim 30, wherein the control system automatically switches flow from a first choke to a second choke.

43. The system of claim 42, wherein the drilling event comprises flow through the first choke being outside of an optimum operating range of the first choke.

44. The system of claim 42, wherein the drilling event comprises the first choke being compromised.

45. The system of claim 42, wherein the drilling event comprises the first choke being locked.

46. The system of claim 42, wherein the drilling event comprises the first choke being plugged.

47. The system of claim 42, wherein the drilling event comprises the first choke being washed out.

48. The system of claim 42, wherein the control system automatically maintains a desired pressure while the flow is switched from the first choke to the second choke.

49. The system of claim 30, wherein the drilling event comprises an operating range of one or more operative chokes being exceeded, and wherein the control system automatically increases a number of the operative chokes in response to detecting that the operating range of the one or more operative chokes being exceeded will occur.

50. The system of claim 30, wherein the drilling event comprises failure of a rotating control device seal.

51. The system of claim 50, wherein the control system automatically diverts flow to a rig choke manifold.

52. The system of claim 50, wherein the control system automatically opens a choke a predetermined amount, whereby pressure across the rotating control device is increasingly relieved.

53. The system of claim 30, wherein the control system automatically communicates rig heave information to a model.

54. The system of claim 30, wherein the drilling event comprises rig heave.

55. The system of claim 54, wherein the control system automatically adjusts annulus volume.

56. The system of claim 54, wherein the control system automatically updates a pressure set point.

57. The system of claim 30, wherein the control system provides an alert in response to the drilling event being indicated.

58. The system of claim 30, wherein the control system provides an alarm in response to detecting that the drilling event will occur.

59. The system of claim 30, wherein the control system provides guidance to an operator in response to detecting that the drilling event will occur.

60. The system of claim 30, wherein the control system provides at least one option in response to detecting that the drilling event will occur.

61. The system of claim 30, wherein the controller controls the drilling operation automatically in response to human authorization of such control of the drilling operation.

* * * * *